US009511841B2

(12) United States Patent
Redfern

(10) Patent No.: US 9,511,841 B2
(45) **Date of Patent: *Dec. 6, 2016**

(54) POWER ASSIST HYDRAULIC STEERING SYSTEM WITH ON DEMAND PUMP

(71) Applicant: Marine Canada Acquisition Inc., Richmond (CA)

(72) Inventor: Richard Redfern, Richmond (CA)

(73) Assignee: Marine Canada Acquisition Inc., Richmond (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/324,989

(22) Filed: Jul. 7, 2014

(65) Prior Publication Data

US 2014/0318114 A1 Oct. 30, 2014

Related U.S. Application Data

(63) Continuation of application No. 12/466,347, filed on May 14, 2009, now Pat. No. 8,769,944.

(60) Provisional application No. 61/053,602, filed on May 15, 2008.

(51) Int. Cl.
*B63H 21/22* (2006.01)
*B63H 25/30* (2006.01)

(52) U.S. Cl.
CPC ..... *B63H 25/30* (2013.01)

(58) Field of Classification Search
CPC ..... B23H 25/30; F16K 11/0716; F04B 9/14
USPC ..... 60/400, 431; 114/146, 150; 137/554; 440/1, 61 S
See application file for complete search history.

(56) References Cited

U.S. PATENT DOCUMENTS

| | | | | |
|---|---|---|---|---|
| 3,896,280 | A * | 7/1975 | Blake | B01D 35/143 137/554 |
| 4,449,469 | A * | 5/1984 | Woolaver | B63H 25/22 114/150 |
| 4,669,494 | A * | 6/1987 | McBeth | F15B 7/06 137/106 |
| 5,031,562 | A * | 7/1991 | Nakase | B63H 25/22 114/150 |
| 5,146,745 | A * | 9/1992 | Doetsch | B63H 25/16 114/144 R |
| 5,427,045 | A * | 6/1995 | Fetchko | B63H 25/30 114/150 |
| 6,564,739 | B2 * | 5/2003 | Doetsch | B63H 25/12 114/150 |
| 6,789,570 | B2 * | 9/2004 | Beyrak | F16K 11/0716 137/554 |
| 7,318,386 | B2 * | 1/2008 | Dudra | B62D 5/093 114/150 |
| 7,364,482 | B1 * | 4/2008 | Wong | B63H 25/28 440/1 |
| 8,769,944 | B2 * | 7/2014 | Redfern | B63H 25/30 114/150 |

* cited by examiner

*Primary Examiner* — Thomas E Lazo
(74) *Attorney, Agent, or Firm* — Cameron IP

(57) ABSTRACT

A power assist hydraulic steering system comprises a helm pump hydraulically connected to a first hydraulic actuator. A power assist pump is hydraulically connected to a second hydraulic actuator. The first and second hydraulic actuators are coupled. A flow sensing mechanism is disposed along a hydraulic conduit which hydraulically connects the helm pump to the first hydraulic actuator. The flow sensing mechanism senses when fluid flows from the helm pump to the first hydraulic actuator. A motor actuates the power assist pump when the flow sensing mechanism senses that fluid is flowing from the helm pump to the first hydraulic actuator. In one embodiment the first hydraulic actuator is a servo cylinder and the second hydraulic actuator is a drive cylinder.

13 Claims, 3 Drawing Sheets

POWER ASSIST HYDRAULIC STEERING SYSTEM WITH ON DEMAND PUMP

BACKGROUND OF THE INVENTION

Field of the Invention

The present invention relates to hydraulic steering systems and, in particular, to power assisted hydraulic steering systems for marine vessels and other vehicles.

Description of the Related Art

Conventional power assisted hydraulic steering systems for marine vessels generally comprise a hydraulic circuit including a helm, a power assist hydraulic pump, and a hydraulic actuator. Hydraulic lines connect the helm to the hydraulic actuator which, in turn, is connected to a rudder. The helm is provided with a hydraulic helm pump which supplies fluid to the hydraulic actuator. The helm is operated by manual rotation of a steering wheel. The power assist hydraulic pump is typically actuated by an engine driven pump or an on-board electric motor which is running any time the ignition or engines are on. Additionally, the power assist hydraulic pump is generally sized to provide full assist at engine idle which results in increased energy expenditure and accelerated system wear.

SUMMARY OF THE INVENTION

It is an object of the present invention to provide an improved power assist hydraulic steering system in which a power assist hydraulic pump is activated upon detection of fluid flow from a helm pump.

There is accordingly provided a power assist hydraulic steering system comprising a helm pump hydraulically connected to a first hydraulic actuator. A power assist pump is hydraulically connected to a second hydraulic actuator. The first and second hydraulic actuators are coupled. A flow sensing mechanism is disposed along a hydraulic conduit which hydraulically connects the helm pump to the first hydraulic actuator. The flow sensing mechanism senses when fluid flows from the helm pump to the first hydraulic actuator. A motor actuates the power assist pump when the flow sensing mechanism senses that fluid is flowing from the helm to the first hydraulic actuator. In one embodiment the first hydraulic actuator is a servo cylinder and the second hydraulic actuator is a drive cylinder.

The power assist hydraulic steering system may also include a hydraulic conduit bypassing the flow sensing mechanism. The hydraulic conduit bypassing the flow sensing mechanism is provided with a check valve to allow the flow of fluid from the first hydraulic actuator to the helm pump and prevent the flow of fluid from the helm pump to the first hydraulic actuator. The power assist hydraulic steering system may further include a relief mechanism hydraulically connected in series between the power assist pump and the second hydraulic actuator. The power assist hydraulic steering system may still further include a spool hydraulically connected in series between the power assist pump and the second hydraulic actuator.

There is also provided a flow sensing mechanism for sensing the flow of fluid from a helm pump to a hydraulic actuator. The flow sensing mechanism comprises a poppet valve and a proximity sensor. The poppet valve has a valve body with an inlet port and an outlet port. A poppet is disposed within the valve body. The poppet has a tip which reciprocatingly extends through the inlet port in response to the flow of fluid from the helm pump to the hydraulic actuator. The proximity sensor senses displacement of the poppet within the valve body in response to the flow of fluid from the helm pump, through the valve body, and to the first hydraulic actuator. In one embodiment the poppet includes a polyhedron, preferably hexahedron, plug and a frustoconical tip.

The invention offers the advantage of increased sensitivity to fluid flow thereby allowing the steering system to operate the motor only when a marine vessel is being steered by an operator. This conserves both energy and the life of the components. Furthermore, the flow sensing mechanism does not unduly limit the flow of fluid. This results in smoother steering.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
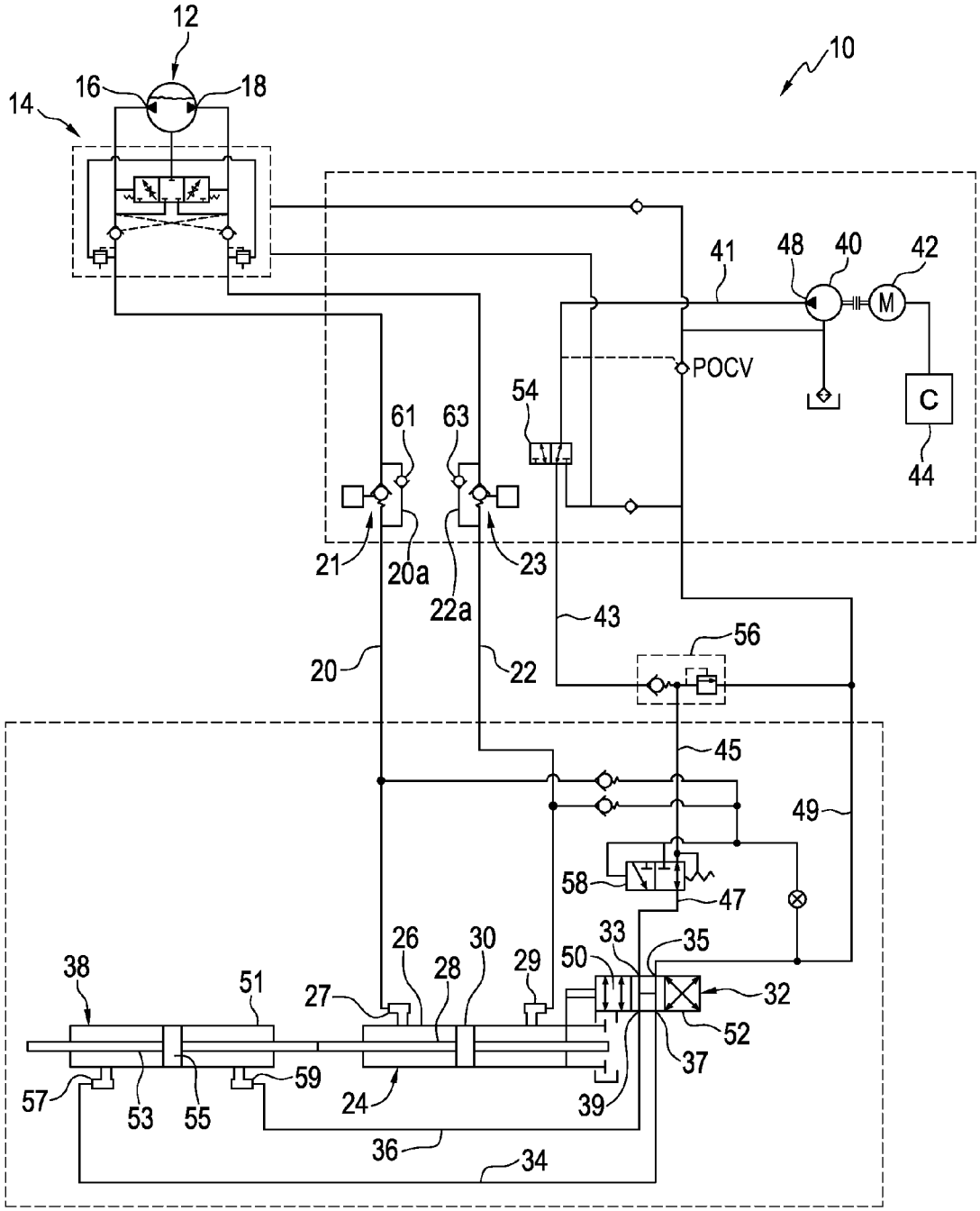
FIG. 1 is a schematic diagram of an improved power assist hydraulic steering system.

Referring to the drawings and first to FIG. 1 this shows an improved power assist hydraulic steering system 10. The steering system 10 includes a manually operable hydraulic steering pump in the form of a conventional rotary helm pump 12. The helm pump 12 is part of a helm 14 which is used to steer a marine vessel (not shown). The helm 14 includes a steering wheel (not shown) operatively coupled to the helm pump 12. The steering wheel is rotated to steer the marine vessel.

The helm pump 12 has a first steering pump port 16 and a second steering pump port 18. Hydraulic conduits 20 and 22 hydraulically connect the helm pump 12 to a first hydraulic steering actuator. In this example, the first hydraulic steering actuator is a servo cylinder 24 provided with a barrel 26, a piston rod 28 reciprocatingly received within the barrel 26, a piston 30 mounted on the piston rod 28, and first and second hydraulic ports 27 and 29 which receive pressurized fluid to move the piston 30 in opposite directions for steering the marine vessel. Hydraulic conduit 20 connects the first pump port 16 of the helm pump 12 to the first hydraulic port 27 of the servo cylinder 24. Hydraulic conduit 22 connects the second pump port 18 of the helm pump 12 to the second hydraulic port 29 of the servo cylinder. Flow sensing mechanisms 21 and 23 are disposed along hydraulic conduits 20 and 22 respectively.

The servo cylinder 24 is also operatively coupled to a control valve. In this example, the control valve is a 3-position, 4-way directional spool valve 32. The spool valve 32 is hydraulically connected, in series, between a power assist pump 40 and a second hydraulic steering actuator which, in this example, is in the form of a drive cylinder 38. The drive cylinder 38 is provided with a barrel 51, a piston rod 53 reciprocatingly received within the barrel 51, a piston 55 mounted on the piston rod 53, and first and second hydraulic ports 57 and 59 which receive pressurized fluid to move the piston 55 in opposite directions for steering the marine vessel. The power assist pump 40 is actuated by a motor 42 which is operated by a controller 44. The drive cylinder 38 and servo cylinder 24 are mechanically connected at their respective piston rods 53 and 28.

The spool valve 32 includes a spool 50 which is sealingly and reciprocatingly received within a valve body 52. The spool valve 32 also has a first valve port 33, a second valve port 35, a third valve port 37, and a fourth valve port 39 each for receiving and/or discharging fluid. A plurality of hydraulic conduits 41, 43, 45, and 47 connect the power assist pump 40 to the first valve port 33 of the spool valve 32. In particular, hydraulic conduit 41 connects a power pump port 48 of the power assist pump 40 to a purge valve 54; hydraulic conduit 43 connects the purge valve 54 to a relief module 56; hydraulic conduit 45 connects the relief module 56 to a sequence valve 58; and hydraulic conduit 47 connects the sequence valve 58 to the spool valve 32 at the first valve port 33 thereof. Hydraulic conduit 49 connects the second valve port 35 of the spool valve 32 to the power assist pump 40. Hydraulic conduit 34 connects the third valve port 37 of the spool valve 32 to the first hydraulic port 57 of the drive cylinder 38, and hydraulic conduit 36 connects the fourth valve port 39 of the spool valve 32 to the second hydraulic port 59 of the drive cylinder 38.

When the helm 14 is steered to port, the helm pump 12 discharges fluid through its first pump port 16. The fluid flows from the helm pump 12, via hydraulic conduit 20, into the servo cylinder 24 at the first hydraulic port 27 thereof. The flow sensing mechanism 21 senses the flow of fluid along hydraulic conduit 20 and signals the controller 44 to operate the motor 42 and consequently the power assist pump 40. As a result, when fluid is discharged by the helm pump 12, fluid is also discharged by the power assist pump 40 through its pump port 48. Fluid from the power assist pump 40 flows into the spool valve 32 at the first valve port 33 thereof. The fluid from the helm pump 12, which flows into the servo cylinder 24, displaces the piston 30 and piston rod 28 within the barrel 26. This displacement causes the spool 50 of the spool valve 32, which is operatively coupled to the servo cylinder 24, to shift within the valve body 52 thereby connecting the first valve port 33 of the spool valve 32 to the third valve port 37 of the spool valve 32. This allows fluid from the power assist pump 40 to flow into the drive cylinder 38 at its first port 57. The servo cylinder 24 and drive cylinder 38 are accordingly both actuated towards the right from the position shown in FIG. 1.

As fluid flows into the respective first hydraulic ports 27 and 57 of the servo cylinder 24 and drive cylinder 38, fluid is also discharged through the respective second hydraulic ports 29 and 59 of each of the cylinders 24 and 38. The fluid discharged from the second hydraulic port 29 of the servo cylinder 24 flows back to the helm pump 12 via hydraulic conduits 22 and **22*a*. The fluid from the servo cylinder 24 therefore bypasses the flow sensing mechanism 23 via conduit 22*a*. Conduit 22*a* includes a check valve 63 which prevents fluid flowing from the helm pump 12 to the servo cylinder 24 from bypassing the flow sensing mechanism 23. The fluid discharged from the second hydraulic port 59 of the drive cylinder 38 flows through hydraulic conduit 36 and enters the spool valve 32 at the fourth valve port 39 thereof. The fluid flows through the spool valve 32, exiting at the second valve port 35 thereof, and returns to the power assist pump 40 via hydraulic conduit 49**.

Conversely, when the helm 14 is steered to starboard, the helm pump 12 discharges fluid through its second pump port 18. The fluid flows from the helm pump 12, via hydraulic conduit 22, into the servo cylinder 24 at the second hydraulic port 29 thereof. The flow sensing mechanism 23 senses the flow of fluid along hydraulic conduit 22 and signals the controller 44 to operate the motor 42 and consequently the power assist pump 40. As a result, when fluid is discharged by the helm pump 12, fluid is also discharged by the power assist pump 40 through its pump port 48. Fluid from the power assist pump 40 flows into the spool valve 32 at the first valve port 33 thereof. The fluid from the helm pump 12, which flows into the servo cylinder 24, displaces the piston 30 and piston rod 28 within the barrel 26. This displacement causes the spool 50 of the spool valve 32, which is operatively coupled to the servo cylinder 24, to shift within the valve body 52 thereby connecting the first valve port 33 of the spool valve 32 to the fourth valve port 39 of the spool valve 32. This allows the fluid from the power assist pump 40 to flow into the drive cylinder 38 at its second hydraulic port 59. The servo cylinder 24 and drive cylinder 38 are accordingly both actuated towards the left from the position shown in FIG. 1.

As fluid flows into the respective second hydraulic ports 29 and 59 of the servo cylinder 24 and drive cylinder 38, fluid is also discharged through the respective first hydraulic ports 27 and 57 of each of the cylinders 24 and 38. The fluid discharged from the first hydraulic port 27 of the servo cylinder 24 flows back to the helm pump 12 via hydraulic conduits 20 and **20*a*. The fluid from the servo cylinder 24 bypasses the flow sensing mechanism 21 via conduit 20*a*. Conduit 20*a* includes a check valve 61 which prevents fluid flowing from the helm pump 12 to the servo cylinder 24 from bypassing the flow sensing mechanism 21. The fluid discharged from the first hydraulic port 57 of the drive cylinder 38 flows though hydraulic conduit 34 and enters the spool valve 32 at the third valve port 37 thereof. The fluid flows through the spool valve 32, exiting at the second valve port 35 thereof, and returns to the power assist pump 40 via hydraulic conduit 49**.

The relief module 56 prevents back pressure from affecting flow sensing mechanisms 21 and 23 in compliance with American Boating & Yacht Council standards.

The flow sensing mechanisms 21 and 23 used in the steering system 10 in this example are able to detect a flow rate of 0.0022 to 0.0029 gallons per minute, although this may vary in other embodiments. This increased sensitivity over prior art flow sensing mechanisms, which typically only detect a minimum flow rate of 0.05 gallons per minute, allows the steering system 10 to run the motor 42 only when a marine vessel is being steered by an operator. This conserves both energy and the life of the components. In addition to increased sensitivity, the flow sensing mechanisms 21 and 23 do not unduly limit the flow of fluid. This results in smoother steering.

Figure 2A:
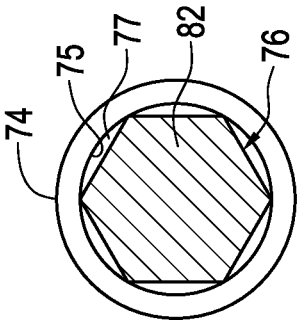
FIG. 2A is a sectional view taken along lines A-A of FIG. 2.
Figure 2:
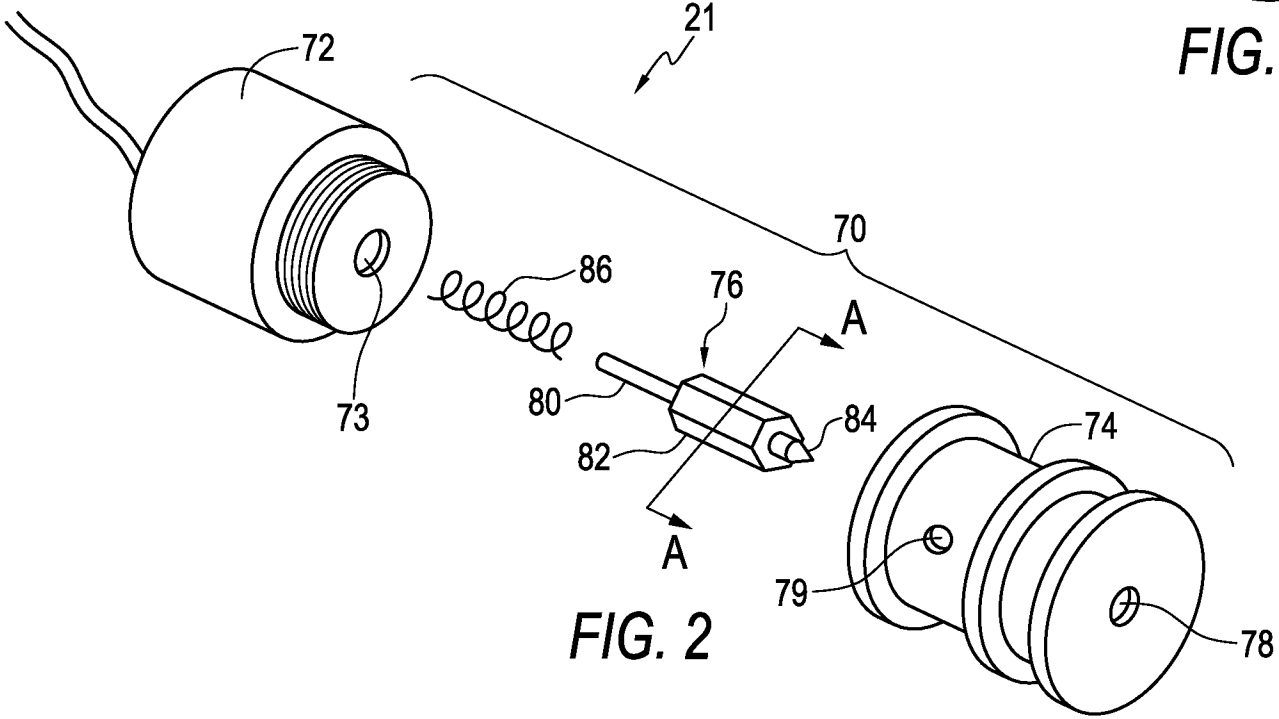
FIG. 2 is an exploded view of a flow sensing mechanism of the power assist hydraulic steering system of FIG. 1.

The flow sensing mechanisms 21 and 23 are substantially identical. Accordingly, only one of the flow sensing mechanisms 21 is described in detail herein with the understanding that a second one of the flow sensing mechanisms 23 has substantially the same structure, and functions in substantially the same manner. Referring to FIG. 2, the flow sensing mechanism 21 includes a poppet valve 70 and a proximity sensor 72. The poppet valve 70 includes a valve body 74 and a poppet 76. The valve body 74 has an inlet port 78 and at least one outlet port 79. The poppet 76 has a stem 80, a plug 82, and a tapered end portion or tip 84. In this example, the plug 82 is a polyhedron and, more specifically, a hexahedron. As best shown in FIG. 2A, the hexahedral shape of the plug 82 ensures that there is a space 77 between the plug 82 and an inner wall 75 of the valve body 74 when the poppet 76 is disposed in the valve body 74.

Figure 3:
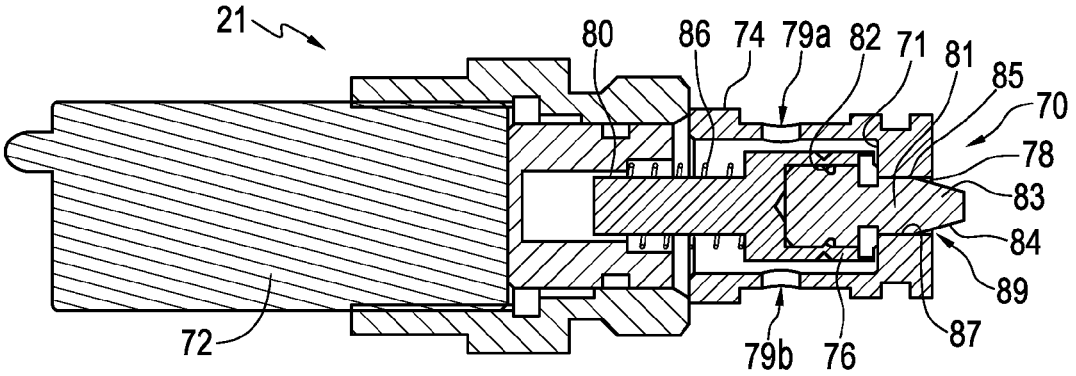
FIG. 3 is a sectional view of the flow sensing mechanism of FIG. 2 showing a valve of the flow sensing mechanism in a closed position.
Figure 4:
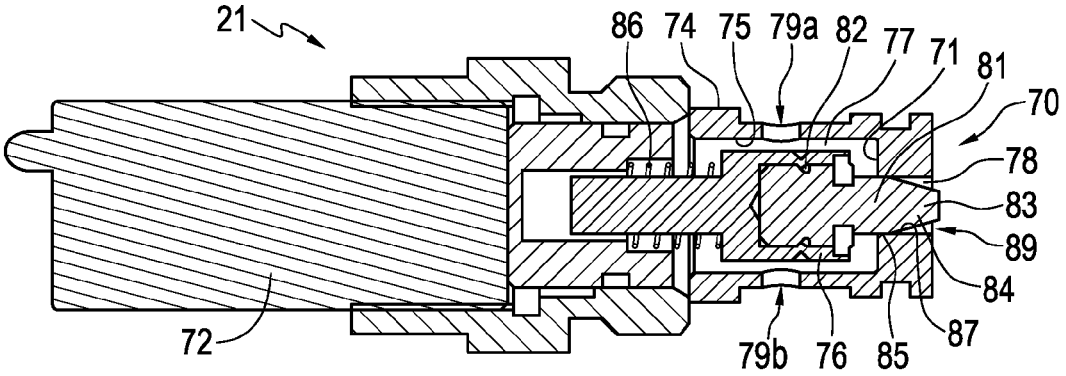
FIG. 4 is a partially sectional view of the flow sensing mechanism of FIG. 2 showing the valve of the flow sensing mechanism at a "turn-on" point.
Figure 5:
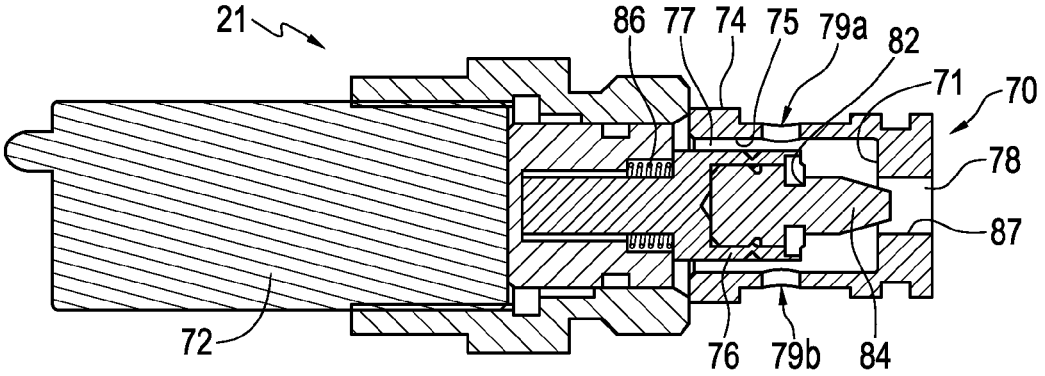
FIG. 5 is a partially sectional view of the flow sensing mechanism of FIG. 2 showing the valve of the flow sensing mechanism in an open position.

Referring back to FIG. 2, a spring 86, which engages the plug 82 of the poppet 76, is used to bias the plug 82 against a valve seat 71, which is shown in FIGS. 3 to 5. Although, in this example, there is no sealing means between the plug 82 and the valve seat 71 in other examples the poppet valve 70 may be provided with suitable sealing means such as an O-ring. The spring 86 and stem 80 of the poppet 76 are received by a recess 73 in the proximity sensor 72. The proximity sensor 72 senses the position of the poppet 76. When the poppet 76 is displaced as a result of fluid flow from the helm pump 12, the proximity sensor 72 signals the controller 44 which operates the motor 42 and consequently actuates the power assist pump 40. As a result, when fluid flows from the helm pump to the servo cylinder 24, fluid simultaneously flows from the power assist pump 40 to the drive cylinder 38.

FIGS. 3 to 5 show one of the flow sensing mechanisms 21 in greater detail.

In FIGS. 3 to 5 the poppet 76 is disposed in the valve body 74. FIGS. 3 to 5 also show two outlet ports 79*a* and 79*b*. Referring specifically to FIG. 3, this shows the poppet valve 70 in a closed position when there is no fluid flow from the helm pump 12. In the closed position the spring 86 biases the plug 82 against the valve seat 71, and the tip 84 of the poppet 76 extends, at least partially, through inlet port 78 and outside the valve body 74. The tip 84 of the poppet 76 has a cylindrical portion 81 and a remote frustoconical portion 83. There is an annular edge 85 where the cylindrical portion 81 and frustoconical portion 83 of tip 84 meet. In the closed position, there is a very small clearance, in one example 0.0003 of an inch, between the cylindrical portion 81 of the tip 84 and an inner wall 87 of the inlet port 78. This inhibits fluid from leaking past the poppet 76, thereby requiring that poppet valve 70 be moved to an open position to allow for fluid flow. There is also an annular recess 89 between the frustoconical portion 83 of the tip and the inner wall 87 of the inlet port 78 when the poppet valve 70 is in the closed position as shown in FIG. 3.

As fluid fills the annular recess 89 between the frustoconical portion 83 of the tip and the inner wall 87 of the inlet port 78, even a low fluid flow rate of, for example, 0.002 gallons per minute will cause the tip 84 of the poppet 76 to partially retract into the valve body 74 as shown in FIG. 4. In FIG. 4 the annular edge 85 of the tip 84 of the poppet valve 76 is approximately level, depending on leakage, with the valve seat 71. This is a "turn-on" position in which fluid does not flow through the poppet valve 70 but displacement of the poppet 76 is sensed by the sensing mechanism 21 which signals the controller 44 to operate the motor 42 and consequently the power assist pump 40. Typically this occurs when an operator first starts to steer the marine vessel.

Referring now to FIG. 5, this shows the poppet valve 70 in an open position. When the poppet valve 70 moves from the "turn-on" position shown in FIG. 4 to the open position shown in FIG. 5, the space 77 between the plug 82 of the poppet 76 and the inner wall 75 of the valve body 74 together with the tapered configuration of the tip 84 of the poppet provide an open path along which fluid may flow through the poppet valve 70. This ensures that the flow sensing mechanism 21 does not impede or limit the flow of fluid.

Accordingly, in the power assist hydraulic steering system disclosed herein, the power assist pump is activated at a low flow rate when fluid is first discharged from the helm pump but before significant fluid flows through the flow sensing mechanisms 21 and 23 to the servo cylinder 24. The end result is smoother steering because fluid flowing from the helm pump 12 reaches the servo cylinder 24 at substantially the same time that fluid flowing from the power assist pump 40 reaches the drive cylinder 38. Energy is also conserved because the motor 42 which actuates the power assist pump 40 is only operated when fluid flows from the helm pump 12.

It will be understood by a person skilled in the art that many of the details provided above are by way of example only and are not intended to limit the scope of the invention, which is to be determined with reference to the following claims.

What is claimed is:

1. A power assist hydraulic steering system comprising:

as helm pump hydraulically connected to a first hydraulic actuator;

a power assist pump hydraulically connected to a second hydraulic actuator, the second hydraulic actuator being coupled to the first hydraulic actuator;

a flow sensing mechanism disposed along a hydraulic conduit which hydraulically connects the helm pump to the first hydraulic actuator, the flow sensing mechanism sensing a flow of fluid from the helm pump to the first hydraulic actuator, and the flow sensing mechanism including a poppet valve and a proximity sensor, the poppet valve having a valve body and a poppet disposed within the valve body, the valve body having an inlet port and an outlet port, and the poppet having a polyhedron plug and a frustoconical tip which reciprocatingly extends through the inlet port in the response to the flow of fluid from the helm pump, through the valve body, and to the first hydraulic actuator; and a motor for actuating the power assist pump, the motor actuating the power assist pump when the flow sensing mechanism senses the flow of fluid from the helm pump to the first hydraulic actuator.

2. The power assist hydraulic steering system of claim 1 wherein the poppet includes a hexahedron plug.

3. The power assist hydraulic steering system of claim 1 further including a hydraulic conduit bypassing the flow sensing mechanism, the hydraulic conduit bypassing the flow sensing mechanism being provided with a check valve to allow the flow of fluid from the first hydraulic actuator to the helm pump and prevent the flow of fluid from the helm pump to the first hydraulic actuator.

4. The power assist hydraulic steering system of claim 1 further including a relief mechanism hydraulically connected in series between the power assist pump and the second hydraulic actuator.

5. The power assist hydraulic steering system of claim 1 further including a spool hydraulically connected in series between the power assist pump and the second hydraulic actuator.

6. The power assist hydraulic steering system of claim 1 wherein the first hydraulic actuator is a servo cylinder.

7. The power assist hydraulic steering system of claim 1 wherein the second hydraulic actuator is a drive cylinder.

8. A power assist hydraulic steering system comprising:

a helm pump hydraulically connected to a servo cylinder;

a power assist pump hydraulically connected to a drive cylinder, the drive cylinder being coupled to the servo cylinder;

a flow sensing mechanism for sensing a flow of fluid from the helm pump to the servo cylinder, the flow sensing mechanism being disposed along a hydraulic conduit which hydraulically connects the helm pump to the servo cylinder and the flow sensing mechanism including a poppet valve and a proximity sensor, the poppet valve having a valve body and a poppet disposed in the valve body, the valve body having an inlet port and an outlet port, the poppet having a polyhedron plug and a frustoconical tip which reciprocatingly extends through the inlet port in response to the flow of fluid from the helm pump, through the valve body, and to the servo cylinder, and the proximity sensor sensing displacement of the poppet within the valve body; and a motor for actuating the power assist pump, the motor actuating the power assist pump when the flow sensing mechanism senses the flow of fluid from the helm pump to the servo cylinder.

9. The power assist hydraulic steering system of claim 8 further including a hydraulic conduit bypassing the flow sensing mechanism, the hydraulic conduit bypassing the flow sensing mechanism being provided with a check valve to allow the flow of fluid from the servo cylinder to the helm pump and prevent the flow of fluid from the helm pump to the servo cylinder.

10. The power assist hydraulic steering system of claim 8 further including a Mid mechanism hydraulically connected in series between the power assist pump and the drive cylinder.

11. The power assist hydraulic steering system of claim 8 further including a spool hydraulically connected in series between the power assist pump and the drive cylinder.

12. A flow sensing mechanism for sensing a flow of fluid from a helm pump to a hydraulic actuator, the flow sensing mechanism comprising:

a poppet valve having a valve body and a poppet disposed within the valve body, the valve body having an inlet port and an outlet port, and the poppet having a polyhedron plug and a frustoconical tip which reciprocatingly extends through the inlet port in response to the flow of fluid from the helm pump, through the valve body, and to the hydraulic actuator; and a proximity sensor, the proximity sensor sensing displacement of the poppet within the valve body.

13. The flow sensing mechanism of claim 12 wherein the poppet includes a hexahedron plug.

* * * * *